US005158130A

United States Patent [19]

Sahari

[11] Patent Number: 5,158,130

[45] Date of Patent: Oct. 27, 1992

[54] METHOD FOR PREPARATION OF MOULDS AND CORES USED IN THE CASTING OF METALS

[76] Inventor: Harri Sahari, Kaartotie 8, 33940, Pirkkala, Finland

[21] Appl. No.: 476,470

[22] PCT Filed: Nov. 30, 1988

[86] PCT No.: PCT/FI88/00192

§ 371 Date: Jun. 5, 1990

§ 102(e) Date: Jun. 5, 1990

[87] PCT Pub. No.: WO89/05204

PCT Pub. Date: Jun. 15, 1989

[30] Foreign Application Priority Data

Dec. 8, 1987 [FI] Finland ..... 875405

[51] Int. Cl.[5] ..... B22C 1/00; B22C 1/18

[52] U.S. Cl. ..... 164/528; 164/522; 164/15

[58] Field of Search ..... 164/529, 528, 522, 132, 164/12, 6, 15

[56] References Cited

U.S. PATENT DOCUMENTS

| | | | |
|---|---|---|---|
| 4,043,380 | 8/1977 | Valentine | 164/528 |
| 4,331,197 | 5/1982 | Cole | 164/528 |
| 4,347,890 | 9/1982 | Ailin-Pyzik | 164/528 |
| 4,399,858 | 8/1983 | Kurabe | 164/528 |
| 4,678,020 | 7/1987 | Hayes | 164/528 |

FOREIGN PATENT DOCUMENTS

| | | | |
|---|---|---|---|
| 52-061126 | 5/1977 | Japan | 164/522 |
| 55-019462 | 2/1980 | Japan | 164/522 |

*Primary Examiner*—Richard K. Seidel
*Assistant Examiner*—Rex E. Pelto
*Attorney, Agent, or Firm*—Steinberg & Raskin

[57] ABSTRACT

The invention concerns a method for the preparation of moulds and cores used in the casting of metals. In the method the moulds and cores are prepared out of a granular moulding material as well as out of a binder agent that binds the moulding-material granules together. The binder agent used for the moulding mix is an anorganic salt, sodium aluminate, soluble in water and having a high melting point, as a rule higher than the casting temperature, which said salt is mixed with the granular moulding material as binder-agent solution dissolved in water. In the moulding process the binder agent is crystallized out of its water solution by microwave energy so that the binder agent forms a solid bridge between the granules of moulding material, said bridge binding the granules of moulding material together. The combination formed by the binder agent and the moulding material is chosen so that the binder agent and the main minerals of the moulding material are chemically unreactive with each other at the moulding and casting temperatures.

3 Claims, No Drawings

METHOD FOR PREPARATION OF MOULDS AND CORES USED IN THE CASTING OF METALS

The subject of the present invention is a method for the preparation of moulds and cores used in the casting of metals, wherein the moulds and cores are prepared out of a granular moulding material as well as out of a binder agent that binds the moulding-material granules together.

For the preparation of moulds and cores used in the casting of metals, in prior art, methods are known in which the granules of moulding sand are bound together by means of organic and/or anorganic binder agents, whose hardening takes place in the moulding mix substantially as a result of a chemical reaction. As the reaction result of such a chemical reaction, a chemical compound is produced which binds the granules of the moulding mix together. A considerable drawback of these prior-art methods is commonly that the disassembling quality of the moulds and cores after the casting is not satisfactory, being even difficult to carry out.

In these methods described above, organic binder agent components are frequently used, which remain in the binder agent as compounded in the moulding mix and which form pyrolysis gases during or after the casting. These pyrolysis gases are again highly detrimental, for they may be dangerous for the health of the workers and cause environmental problems. Moreover, pyrolysis gases cause gas porousity in the cast pieces. Moreover, in these prior-art methods, the compounds produced as a result of the chemical reaction taking place in the hardening of the binder agent restrict the re-use of the moulding material granules substantially as well as increase the cost of regeneration of the moulding material. This comes from the fact that the compounds produced as a result of the chemical reaction are of a stable nature, and breaking up of the binder-agent bond requires a very large amount of energy if the moulding material is supposed to be obtained even as tolerably pure granules for re-use. Moreover, disassembling of the cast and regeneration of the moulding sand require mechanical working steps, wherein an abundance of dust and waste are produced, causing problems of safety at work, environmental problems, high investment costs for reduction of the emissions, as well as costs of disposal of the waste. It is, among other things, because of the pyrolysis gases, dust and waste mentioned above that efficient and costly air-conditioning and filtering systems must be constructed in foundries.

In prior art, such methods for the preparation of casting moulds and cores are also known wherein anorganic salts soluble in water are also used as a binder agent. However, in these methods the hardening of the binder agent takes place by the intermediate of a chemical reaction. One such method has been described earlier, e.g. in the U.S. Pat. No. 4,399,858. It is a considerable drawback of such methods that the reaction products that bind the granules of moulding material together have a low melting point. This again results in the circumstance that the granules of moulding material are detached and carried along with the molten metal flow in particular when alloys of a high melting point are cast.

A prior-art method is the so-called water-glass method, wherein water-glass is used as the binder agent, said water-glass being a technical product developed expressly for the water-glass binder-agent method. However, in such a method it is essential that the water-glass must contain an abundant excess quantity of the silicate component. This results in the fact that the binder agent is not dissolved in water completely, but it forms a readily hydrolyzable pseudo-solution, whereby the excess $SiO_2$ gel is liberated. When such a $Na_2O \cdot SiO_2$ compound, whose $SiO_2$ concentration is, as a rule, about 2.5-fold as compared with normal sodium-metasilicate, loses its solvent, i.e. water, out of it a fully insoluble compound, is formed between the moulding granules. This is why a mould or core prepared by means of the water-glass method cannot be disassembled or emptied so that the binder agent is dissolved off from between the granules. Moreover, in the water-glass method, in the hardening, mostly $CO_2$-gassing is used, as a result of which sodium carbonates are formed and an increased excess quantity of the $SiO_2$ gel component is formed, whereby the solubility is reduced further. In such a prior-art water-glass method, when the binder agent comes into contact with carbon dioxide, carbonates are formed, and when it comes into contact with other impurities, other insoluble compounds are formed. Thus, it is an essential and characteristic feature of the prior-art methods that therein chemical reactions always take place, as a result of which insoluble compounds are formed. It is a further essential drawback of the prior-art water-glass method that the prior-art water-glass has no accurate melting point, but it has an indefinite "melting range", which starts from quite a low temperature.

The object of the present invention is to provide an essential improvement over the prior-art methods and, also, to avoid the drawbacks related to the prior-art methods. In view of achieving this, the invention is characterized in that the binder agent used for the moulding mix is an anorganic salt soluble in water and having a high melting point, as a rule higher than the casting temperature, which said salt is mixed with the granular moulding material as binder-agent solution dissolved in water and which said salt is, in the moulding process, crystallized out of its water solution physically so that the binder agent forms a solid bridge between the granules of moulding material, said bridge binding the granules of moulding material together, the chemical properties of said salt being retained unchanged in the moulding process and in the casting process, and said salt being, after the casting process, dissolvable in water or in an unsaturared water solution of the binder agent so as to disassemble the parts of the mould.

Thus, in the method of the invention, the moulds and cores are prepared by binding the granules of moulding material together by means of an anorganic salt soluble in water whose melting point is, as a rule, higher than the casting temperature of metals. Compared with the prior art, by means of the method of the invention, several significant advantages are obtained, of which, e.g., the following should be mentioned.

In the method of the invention, during the moulding, no emissions detrimental to the health of the workers are produced, because the hardening of the binder agent takes place without a chemical reaction, and in the process no catalyst gases are needed.

During or after the casting, when the metal solidifies or cools, no pyrolysis gases are formed, which would be detrimental to the environment, to the health of the workers, or to the quality of the cast.

After solidification of the cast, the disassembly of the mould and of the cores can be carried out simply by dissolving the binder agent off by means of water or an unsaturated water solution of the binder agent.

The moulding material that has been used for moulding and for making the core can be regenerated easily along the wet route for re-use.

In the following, the invention will be described in more detail by stating the various steps of the method of the invention separately.

a) The binder agent that is used in the method of the invention is an anorganic compound of a high melting point, in particular an anorganic salt, which is soluble in water. It is an essential feature of the binder agent that its melting point is so high that it is, as a rule, not molten even at the casting temperatures.

b) Moreover, as to its properties, the binder agent is such that, at the temperatures occurring during the moulding and casting, it does not react chemically with the main minerals in the granules of the moulding material and, consequently, it does not form compounds insoluble in water.

c) Out of the binder agent in accordance with sections a) and b), first a water solution is prepared, which is mixed with the granules of moulding material.

d) Owing to the surface tension of the binder-agent solution, the binder-agent solution forms a liquid bridge, because of the gathering of liquid, at the contact points between particles of moulding material.

e) The binder-agent solution has a high viscosity, and it has a high adhesion to the main mineral of the granules of the moulding material, which results in that the granules of moulding material are "glued" onto each other and keep the moulding mix together and mouldable even though the binder agent itself is still in the form of a solution.

f) When the water, which is used as the solvent in the solution of binder agent, is removed out of the moulding mix present in the mould or core, a solid bridge of binder agent is formed in place of the liquid bridge described under d), which said solid bridge fixes the granules of moulding material firmly to each other. The physical state of said "solid" binder-agent bridge is partly crystalline, partly amorphous. The above removal of the solvent of the binder-agent solution out of the molding mix can be carried out, e.g., by evaporation, vaporization or boiling. It is a further essential feature cf the method of the invention that the removal of the solvent out of the binder agent must be carried out so that the binder-agent salt used does not react with any secondary substance. Such secondary substances are, e.g., the moulding granule itself, contaminations on the granule, dip coating materials, molten metal, reactive gases in the air. This property is essential for the invention, because the binder-agent salt must not form a new chemical compound which is insoluble or poorly soluble in the solvent used.

g) Since the binder agent possesses the properties listed above under a) and b), at the temperatures prevailing during the casting process it does not melt, decompose or burn, because of which, in connection with the casting, no pyrolysis gases are formed, which would, in the contrary case, cause increased pressure in the cores and in the parts of the mould and, further as a result of that, gas porousity in the cast pieces. Generally speaking, gas porousity is a significant drawback in the present-day methods.

h) The disassembling of the cast is carried out by dissolving the binder agent soluble in water by means of water away from the contact points between the granules of moulding material and from the granule faces.

i) The granules of moulding material can be re-used immediately upon washing and drying. The drying can be carried out, e.g., by centrifuging alone.

j) The quantity of the dissolved binder agent used in the method is about 0.5 . . . 20 per cent by weight of the total quantity of the moulding material. Optimally, the quantity of dissolved binder agent is 1 . . 5 per cent by weight of the moulding material.

k) It is an essential and highly significant feature of the method of the invention that the combination of the binder agent and moulding-granule material used in the method is chosen so that, even at a high casting temperature, they do not react chemically with each other so that a reaction result insoluble in water were formed.

l) As a combination of binder agent and moulding-granule material in accordance with section k) the following combination will be used: As the binder agent sodium aluminate $NaAlO_2$, i.e. $Na_2O \cdot Al_2O_3$, and as the moulding-granule material corundum granules, i.e. aluminium oxide $Al_2O_3$. The molar ratio of the binder agent may vary within certain limits, but it is favourably, e.g., 1:1.

In the following, an example is given of the way in which a casting mould or a core is prepared by means of the method in accordance with the invention.

EXAMPLE

First the necessary moulding mix is prepared by mixing the granules of moulding material and the binder-agent solution with each other at a temperature of 20 . . . 120° C. so that the binder-agent solution smears the surfaces of the moulding material granules throughout. When the moulding mix has been mixed, the mould is moulded and the core is prepared, still at 20 . . . 120° C., in the usual way. Thus, the moulding can be carried out:

1) by packing by hand or by moulding by hand,
2) by moulding by means of a sand sling,
3) by shooting by means of a core shooter,
4) by vibrating and/or compressing,
5) by any other known method, whereby a loosely coherent mould or core is obtained.

A "fresh" mould or core produced in the way described above is brought to the desired treatment consistency by drying it partly or fully. The drying is carried out in the following way:

Crystallization of the binder agent out of its water solution is induced thereby that the mould and/or the core are placed in an electric and/or magnetic field of alternating direction, whereby the warming up of the moulding mix takes place by the effect of the increasing kinetic energy of the electrically or magnetically polarized molecules or atomic groups. This is accomplished by heating the mould or core in a microwave oven or high-frequency oven, whereat, by the effect of the movement of the water dipoles contained in the moulding mix, the moulding mix is heated internally and hardens simultaneously in all of its parts.

In the method in accordance with the invention, air cannot be used in evaporation of the solvent, not even as heated, because in such a case the binder-agent film, as yet in solution form, would react detrimentally, e.g., with the carbon dioxide contained in the air, as a result of which poorly soluble carbonates would be formed.

In the method of the invention, the removal of the solvent out of the moulding mix must be carried out expressly by boiling (i.e. the vapour pressure of the solvent must be higher than the pressure of the air, gas or vapour in the environment), whereby the solvent present in the binder-agent film in the moulding material is boiled off and the anorganic salt crystallizes fully as such while, at the same time, joining the moulding granules together. In the method of the invention, it must be possible to make the solvent boil substantially simultaneously in every part of the moulding material so that the boiling of the solvent does not proceed slowly from the surface of the moulding mix towards the interior parts. In the contrary case, in such a slowly proceeding boiling, the solvent present in the mix would always be condensated detrimentally in the colder portion of moulding material. This is why, in the method of the invention, it is necessary to use a heating method that heats the solvent to the boiling point (in a saturated solution) at the same time in every point in the moulding material. A heating method of this sort is the electromagnetic field with rapidly alternating direction, mentioned above, said field acting upon the polarized molecules of water so that the solvent becomes hot and ultimately is boiled off completely.

The solid mould or core prepared in the way described above is dip coated or covered by means of some material that rejects molten metal. The dip coat material is a material in which the solvent or the liquid component of the physical mixture of the dip coat material is a liquid that does not dissolve the binder agent of the core or mould. Thus, water must not be used as the solvent or liquid component. When sodium aluminate is used as the binder agent, e.g., concentrated (absolute) ethyl alcohol or acetone may be used as the solvent of the dip coat material. The solvent of the dip coat material and the remainder of the solvent of the binder agent of the core or mould, if any, are removed out of the mould or core hereupon in some way corresponding to those used for drying the mould and core.

Hereupon the casting moulds and cores are put together for the casting process, which said putting together can be carried out by the methods in common use.

If the casting mould is used for the casting of objects that include thin walls or equivalent, the mould with its core may be heated before the casting so as to improve the fluidity of the metal or metal alloy. The preheating can be carried out, e.g., up to 50 . . . 500° C. without doing harm to the binder agent.

On the other hand, in order to produce a chill effect, the casting mould with its core can be cooled, e.g., to a temperature of 0 . . . −150° C., which does not have a detrimental effect on the binder agent either. The cooling can be carried out, e.g., by means of a cold gas, such as air, nitrogen or argon, which does not react with the binder agent chemically, with a reaction result insoluble in water produced in the reaction.

The casting mould with its core may be cast either normally in a foundry atmosphere or under negative pressure at a desired vacuum. Depending on the desired quality of cast and/or on the metal alloy to be cast, the casting mould with its core may also be filled with a suitable inert gas, such as nitrogen or argon, whereby reaction of active gases with molten metal is prevented.

In a mould and core prepared in the way described above, there is abundant space between the moulding granules, which promotes the movements of the necessary gases in the moulds or cores, which means that the gas penetrability of a finished mould and core is very good. The gas penetrability can be maximized when the particle size of the moulding material is as large as possible and when the granules of moulding material are of equal size. The strength of the core or mould is, nevertheless, sufficiently high. In moulds and cores produced by conventional methods, as a rule, granules of uniform size are not used, because in such a case the moulds and cores would fall to pieces.

After the cast metal or metal alloy has crystallized, the disassembly of the moulds and cores can be carried out simply by dissolving the binder agent of the moulding material away by means of water, because the binder agent used is such that, after possible filling with inert gas, heating or cooling, casting, and crystallization of the cast metal, it is redissolved into the solvent, i.e. water, whereby the disassembly of the cast takes place without dust and without detrimental emissions in a liquid phase. This is why, in the method of the invention, among other things, the drawbacks of prior art related to safety at work and to environmental issues, which were already mentioned in the description part of the present application, are avoided. The dissolving of the binder agent can be carried out, e.g., by means of a water jet, water-steam jet, or by submerging the piece into water.

After the mould or core has been disassembled in the way described above, the moulding-material granules are separated from the mixture of water solution for re-use after washing and drying treatment. Thus, in the method the binder agent can always be used again, whereby an almost closed circulation is achieved. A solution of binder agent in water can be used for disassembling, depending on the temperature, until the concentration of the binder agent in the solution has increased to 30 . . . 50 per cent by weight. The sludge produced from the dip coat material can be removed from the disassembly solution by filtration. The binder agent can be separated from the disassembly solution, when cold, by crystallization, or by evaporating the solution to dryness. The binder-agent solution is strongly alkaline, but it does, however, not make waters eutrophic, whereby it does not cause damage to the environment. Ferrous metals do not become rusty by the effect of the binder-agent solution, for the binder-agent solution passivates the surface of ferrous metals.

Above, the method in accordance with the invention has been described by means of an example, the invention being, however, not confined to said example alone. The invention may be modified and varied within the scope of the inventive idea defined in the accompanying patent claims.

I claim:

1. A method for the preparation of moulds and cores in the casting of metals, comprising preparing a moulding mixture by mixing granules of a moulding material comprising corundum with a aqueous solution of a binding agent comprising sodium aluminate having a molar ratio of about 1:1;

crystallizing said binding agent out of said moulding mixture substantially without said binding agent reacting with carbon dioxide from any source by applying microwave energy to said moulding mixture in a substantially uniform manner until all of the water in said moulding mixture is removed, such that said binding agent forms a solid bridge binding said granules of said moulding material together, wherein the chemical properties of said binding agent are retained unchanged during the moulding process and the casting process and that after the casting process the binding agent is dissolvable in water or in an unsaturated water solution of said binding agent so as to easily disintegrate the mould with water in the shake-out stage.

2. The method of claim 1, further comprising dip-coating the solid mould formed after the crystallization step is completed with a material in which the solvent or liquid component of the material does not dissolve said binding agent.

3. The method of claim 2, wherein said moulding material and said binding agent are mixed at a temperature from about 20° C. to about 120° C.

* * * * *